US009309895B2

(12) United States Patent
Siddle et al.

(10) Patent No.: US 9,309,895 B2
(45) Date of Patent: Apr. 12, 2016

(54) CLOSED IMPELLER WITH A COATED VANE

(75) Inventors: Dave Siddle, Greensburg, PA (US); Sudhir Brahmandam, Irwin, PA (US); Irene Spitsberg, Export, PA (US)

(73) Assignee: KENNAMETAL INC., Latrobe, PA (US)

( * ) Notice: Subject to any disclaimer, the term of this patent is extended or adjusted under 35 U.S.C. 154(b) by 893 days.

(21) Appl. No.: 13/525,562

(22) Filed: Jun. 18, 2012

(65) Prior Publication Data

US 2013/0336776 A1 Dec. 19, 2013

(51) Int. Cl.

*F04D 29/02* (2006.01)
*F04D 29/16* (2006.01)
*F04D 29/22* (2006.01)

(52) U.S. Cl.

CPC ..... *F04D 29/026* (2013.01); *F04D 29/167* (2013.01); *F04D 29/2222* (2013.01); *F04D 29/2294* (2013.01)

(58) Field of Classification Search

CPC ..... F04D 29/026; F04D 29/2294; F04D 29/2261; F04D 29/2222; F04D 29/165; F04D 29/167; F04D 29/007

See application file for complete search history.

(56) References Cited

U.S. PATENT DOCUMENTS

| | | | |
|---|---|---|---|
| 3,743,556 | A | 7/1973 | Barton et al. |
| 3,841,791 | A | 10/1974 | Doolin |
| 4,427,445 | A | 1/1984 | Holzl et al. |
| 4,720,242 | A | 1/1988 | Lovisetto |
| 5,120,613 | A | 6/1992 | Basler et al. |
| 5,385,789 | A | 1/1995 | Rangaswamy et al. |
| 5,503,687 | A | 4/1996 | Berns |
| 6,800,383 | B1 | 10/2004 | Lakhotkin et al. |
| 7,744,986 | B2 | 6/2010 | Rice et al. |
| 2004/0062864 | A1 | 4/2004 | Langley et al. |
| 2006/0040129 | A1 | 2/2006 | Darolia et al. |
| 2008/0145566 | A1 | 6/2008 | Cretegny et al. |

(Continued)

FOREIGN PATENT DOCUMENTS

| | | | |
|---|---|---|---|
| CN | 201129304 | Y | 10/2008 |
| GB | 2475533 | A | 5/2011 |

(Continued)

OTHER PUBLICATIONS

Khalid, Y and Sapuan, S; "Wear analysis of centrifugal slurry pump impellers"; 2007; Industrial Lubrication and Tribology, vol. 59(1), pp. 18-28.*

(Continued)

*Primary Examiner* — Edward Look
*Assistant Examiner* — Danielle M Christensen
(74) *Attorney, Agent, or Firm* — Larry R. Meenan

(57) ABSTRACT

A closed impeller has a base cover, which has a base interior surface, and a second cover. A vane, which has an inlet distal end and an outlet distal end, is on the base interior surface. The vane has low and high pressure side surfaces wherein they have a low or high pressure midpoint, respectively. A hard coating is on the low and high pressure side surfaces. The hard coating has a minimum low and high pressure coating thickness at their respective midpoints. The minimum low, as well as high, pressure coating thickness ranging between about 0.085 and about 0.8 of either one of the maximum outlet coating thickness at the outlet distal end or the maximum inlet coating thickness at the inlet distal end, respectively.

24 Claims, 4 Drawing Sheets

(56) References Cited

U.S. PATENT DOCUMENTS

| | | | | |
|---|---|---|---|---|
| 2009/0016895 | A1 | 1/2009 | Beez et al. | |
| 2009/0214787 | A1 | 8/2009 | Wei et al. | |
| 2009/0218011 | A1 | 9/2009 | Blaauw et al. | |
| 2010/0272563 | A1 * | 10/2010 | Chiovelli | 415/204 |
| 2011/0014059 | A1 | 1/2011 | Giovannetti et al. | |
| 2011/0165433 | A1 | 7/2011 | Pabla et al. | |

FOREIGN PATENT DOCUMENTS

| | | | |
|---|---|---|---|
| JP | 2012102641 | A | 5/2012 |
| WO | WO 2009143570 | A1 * | 12/2009 |

OTHER PUBLICATIONS

Wei et al., "Deposition of Thick Nitrides and Carbonitrides for Sand Erosion Protection", Surface & Coatings Technology, vol. 201 (2006) pp. 4453-4459.

Colvin, "Wear-Resistant Cladding Helps Compounder Overcome Problems", Modern Plastics Worldwide, Feb 2007, (2 pages).

"Extended Life of induced Draft Fan Blades from 5-8 Months to over 30 Months", Tennessee Valley Authority, Kingston, TN Conforma Clad Success Story, (2006) (2 pages).

K-4003USSG1 Search Report and Written Opinion mailed Sep. 11, 2014.

Office action of Sep. 23, 2015 from German Patent Office in German Patent Application No. 10 2013 105 200.2 [5 pages German language].

English translation of Office action of Sep. 23, 2015 from German Patent Office in German Patent Application No. 10 2013 105 200.2 [4 pages].

* cited by examiner

CLOSED IMPELLER WITH A COATED VANE

BACKGROUND

The invention pertains to a closed impeller that includes a coated vane. More specifically, the invention pertains to a closed impeller with a coated vane wherein the coating scheme on the coated vane increases the effective life of the closed impeller. The coating scheme does this by improving the erosion resistance and the corrosion resistance of the coated vane without negatively impacting the mechanical performance characteristics of the closed impeller.

In certain environments, pumps, flow control devices, and other articles that are used to move or transport fluids and slurries are subject to the effects of erosive and corrosive fluids and slurries. One exemplary such article is a closed impeller, which typically is a component of a pump or other article useful to move or transport fluids. In many instances, the impact of the fluid and/or slurries via erosion and/or corrosion diminishes the performance of the closed impeller, and hence, the article (e.g., pump) of which the closed impeller is a component.

Problems caused by erosion and/or corrosion are common to many kinds of articles useful for transport and/or movement of fluids and slurries. In an effort to address this problem of erosion and/or corrosion in the context of a variety of applications, diffusion processes such as, for example, nitriding (e.g., solution nitriding) have been used to provide some protection to the components experiencing erosion and/or corrosion. For example, U.S. Pat. No. 5,503,687 to Berns discloses a solution nitriding of stainless steel in the context of high-speed pump gears and impellers. While a process such as solution nitriding has provided some improvement, in some applications there remains a need to provide a way to treat a component such as a closed impeller so as to improve the effective life thereof.

A cladding process has been used in an effort to improve the life of the components. In such a process, a flexible tungsten carbide-cobalt layer is positioned on the critical surfaces and affixed thereto. U.S. Pat. No. 3,743,556 to Breton et al. shows an exemplary cladding process. A flexible tungsten carbide-cobalt cladding is available from ConformaClad, 501 Park East Blvd., New Albany, Ind. 47150. This flexible cladding can be used to protect against fly ash erosion in a draft turbine blade (see ConformaClad brochure entitled "Tennessee Valley Authority"), as well as to protect against wear in an extruder barrel (see Robert Colvin, "Wear-resistant cladding helps compounder overcome problems", Modem Plastics Worldwide February 2007).

While the cladding process provides acceptable results with regard to erosion resistance and corrosion resistance, there are limitations associated with the cladding process. First, because of the nature of the process, cladding is not especially applicable to hard-to-reach-reach areas since they cannot be accessed to apply the flexible cladding layer. Second, if dimensional tolerances for the component(s) are tight, the cladding process is typically not suitable for use. Because of the dimensionally tight and hard-to-reach structural features of a closed impeller, the use of the cladding process has limited application to a closed impeller, and especially to the vanes of a closed impeller. Therefore, while a cladding process may be suitable for some applications, there remains a need to provide a way to treat a component such as a closed impeller so as to improve of the effective life thereof, especially when the areas needing protection are hard-to-reach and/or require tight dimensional tolerances.

In the context of a closed impeller, the geometry and physical properties of the vanes, as well as other components, can affect the performance of the closed impeller. The nature of a closed impeller mandates a requirement that the adhesion of a coating to the vane be excellent. Poor adhesion of the coating on the vane results in a decrease of the effective life of the closed impeller. It therefore would be advantageous to provide a coating on a closed impeller (and especially the vane of a closed impeller) that has excellent adhesion. It would be especially desirable if the coating scheme was metallurgically bonded to the surface of the substrate of the vane.

The nature of a closed impeller also mandates that the control over the thickness of the coating be very precise. Unintended variations in the coating thickness can result in a loss of dimensional tolerances that can lead to a decrease of operational performance, as well as a decrease in the effective life of the closed impeller. Further, unintended variations in the coating thickness can cause weight imbalances that are detrimental to the operational performance of the closed impeller and which can result in a decrease in the effective life of the closed impeller. These unintended coating thickness variations are due to the current focus on controlling the thickness to a consistent value throughout the component due to the flux irregularities amplified by the complex geometries of the part. It would be of great benefit to provide a coating on a closed impeller (and especially the vane of the closed impeller) that does not possess unintended variations in the thickness of the coating.

Up until now, the requirements for coating adhesion and control over coating thickness have restricted the coating scheme on a vane of a closed impeller to a single coating layer. Yet, some coating processes used to apply a single coating layer have significant drawbacks. A process such as a thermal spray process (e.g., see U.S. Pat. No. 5,385,789 to Rangaswamy et al.) does not apply an optimum coating scheme because the high heat actually distorts the geometry of the components including the vanes of the closed impeller. For similar reasons, a plasma transfer arc process (e.g., U.S. Pat. No. 5,705,786 to Solomon et al.) does not apply an optimum coating scheme because the high heat distorts the geometry of the components including the vanes of the closed impeller. It would thus be desirable to provide a way to treat (e.g., coat) a component such as a closed impeller (and especially the vanes of a closed impeller) so that the coating process does not distort the geometry of the component.

Typical chemical vapor deposition (CVD) techniques are not suitable because the higher deposition temperatures distorts the geometry of the components including the vanes of the closed impeller. It would be desirable to provide a way to treat a component such as a closed impeller without the need to use higher deposition temperatures such as are extant with CVD techniques.

In addition, CVD techniques and PVD techniques do not provide an optimum coating scheme because they are limited in the magnitude of the thickness of the coating scheme. Conventional PVD techniques typically have a coating thickness limitation of about 10 micrometers. Conventional CVD techniques typically have a coating thickness limitation of about 25 micrometers to about 30 micrometers along with a deposition temperature of at least about 800° C. The thickness of the coating on a vane of a closed impeller should be at least about 35 micrometers. Therefore, it would be highly desirable to provide a coating on a closed impeller (and especially the vane of the closed impeller) that exhibits sufficient thickness such as, at least about 35 micrometers.

An unanticipated failure mode of impellers is the premature loss of balance due to accelerated wear at the inlet and outlet regions of the vanes. Simple velocity profiles would suggest that the outlet will experience higher wear due to the higher velocity, but detailed examinations show that the inlet region due to the change in direction of the fluid causes localized accelerated wear. Therefore the profile of the wear resistant coating layer needs to have additional material at this inlet and outlet regions as compared to other locations along the vane.

It becomes apparent that drawbacks exist with the current techniques used to apply a coating scheme to an article like a closed impeller, and especially to apply a coating to a vane of a closed impeller. It would be highly beneficial to provide solutions to these drawbacks.

SUMMARY OF THE INVENTION

In one form, the invention is a closed impeller that comprises a base cover that has a base interior surface, a second cover, and a vane on the base interior surface wherein the vane is of a generally arcuate shape and has an inlet distal end and an outlet distal end. The vane has a low pressure side surface, which has a low pressure length between the inlet distal end and the outlet distal end, and a low pressure midpoint on the low pressure length approximately midway between the inlet distal end and the outlet distal end. A hard low pressure coating is on the low pressure side surface wherein the hard low pressure coating has a minimum low pressure coating thickness at the low pressure midpoint, a maximum low pressure outlet coating thickness at the outlet distal end, and a maximum low pressure inlet coating thickness at the inlet distal end. The minimum low pressure coating thickness ranges between about 0.085 and about 0.8 of either one of the maximum low pressure outlet coating thickness at the outlet distal end or the maximum low pressure inlet coating thickness at the inlet distal end. The vane has a high pressure side surface, which has a high pressure length between the inlet distal end and the outlet distal end, and a high pressure midpoint on the high pressure length approximately midway between the inlet distal end and the outlet distal end. A hard high pressure coating is on the high pressure side surface wherein the hard high pressure coating has a minimum high pressure coating thickness at the high pressure midpoint, a maximum high pressure outlet coating thickness at the outlet distal end, and a maximum high pressure inlet coating thickness at the inlet distal end. The minimum high pressure coating thickness ranges between about 0.085 and about 0.8 of either one of the maximum high pressure outlet coating thickness at the outlet distal end or the maximum high pressure inlet coating thickness at the inlet distal end.

In yet another form thereof, the invention is a coated impeller vane that comprises a vane substrate and a hard coating. The vane is of a generally arcuate shape and has an inlet distal end and an outlet distal end. The vane has a low pressure side surface, which has a low pressure length between the inlet distal end and the outlet distal end, and a low pressure midpoint on the low pressure length approximately midway between the inlet distal end and the outlet distal end. A hard low pressure coating is on the low pressure side surface wherein the hard low pressure coating has a minimum low pressure coating thickness at the low pressure midpoint, a maximum low pressure outlet coating thickness at the outlet distal end, and a maximum low pressure inlet coating thickness at the inlet distal end. The minimum low pressure coating thickness ranges between about 0.085 and about 0.8 of either one of the maximum low pressure outlet coating thickness at the outlet distal end or the maximum low pressure inlet coating thickness at the inlet distal end. The vane has a high pressure side surface, which has a high pressure length between the inlet distal end and the outlet distal end, and a high pressure midpoint on the high pressure length approximately midway between the inlet distal end and the outlet distal end. A hard high pressure coating is on the high pressure side surface wherein the hard high pressure coating has a minimum high pressure coating thickness at the high pressure midpoint, a maximum high pressure outlet coating thickness at the outlet distal end, and a maximum high pressure inlet coating thickness at the inlet distal end. The minimum high pressure coating thickness ranges between about 0.085 and about 0.8 of either one of the maximum high pressure outlet coating thickness at the outlet distal end or the maximum high pressure inlet coating thickness at the inlet distal end.

In still another form thereof, the invention is a pump that comprises a pump housing that has an inlet and an outlet. There is a closed impeller within the pump housing wherein the closed impeller comprises a base cover that has a base interior surface and a second cover. A vane is on the base interior surface wherein the vane is of a generally arcuate shape and has an inlet distal end and an outlet distal end. The vane has a low pressure side surface, which has a low pressure length between the inlet distal end and the outlet distal end, and a low pressure midpoint on the low pressure length approximately midway between the inlet distal end and the outlet distal end. A hard low pressure coating is on the low pressure side surface wherein the hard low pressure coating has a minimum low pressure coating thickness at the low pressure midpoint, a maximum low pressure outlet coating thickness at the outlet distal end, and a maximum low pressure inlet coating thickness at the inlet distal end. The minimum low pressure coating thickness ranges between about 0.085 and about 0.8 of either one of the maximum low pressure outlet coating thickness at the outlet distal end or the maximum low pressure inlet coating thickness at the inlet distal end. The vane has a high pressure side surface, which has a high pressure length between the inlet distal end and the outlet distal end, and a high pressure midpoint on the high pressure length approximately midway between the inlet distal end and the outlet distal end. A hard high pressure coating is on the high pressure side surface wherein the hard high pressure coating has a minimum high pressure coating thickness at the high pressure midpoint, a maximum high pressure outlet coating thickness at the outlet distal end, and a maximum high pressure inlet coating thickness at the inlet distal end. The minimum high pressure coating thickness ranges between about 0.085 and about 0.8 of either one of the maximum high pressure outlet coating thickness at the outlet distal end or the maximum high pressure inlet coating thickness at the inlet distal end.

BRIEF DESCRIPTION OF THE DRAWINGS

The following is a brief description of the drawings that comprise a part of this patent application.

DETAILED DESCRIPTION

Figure 1:
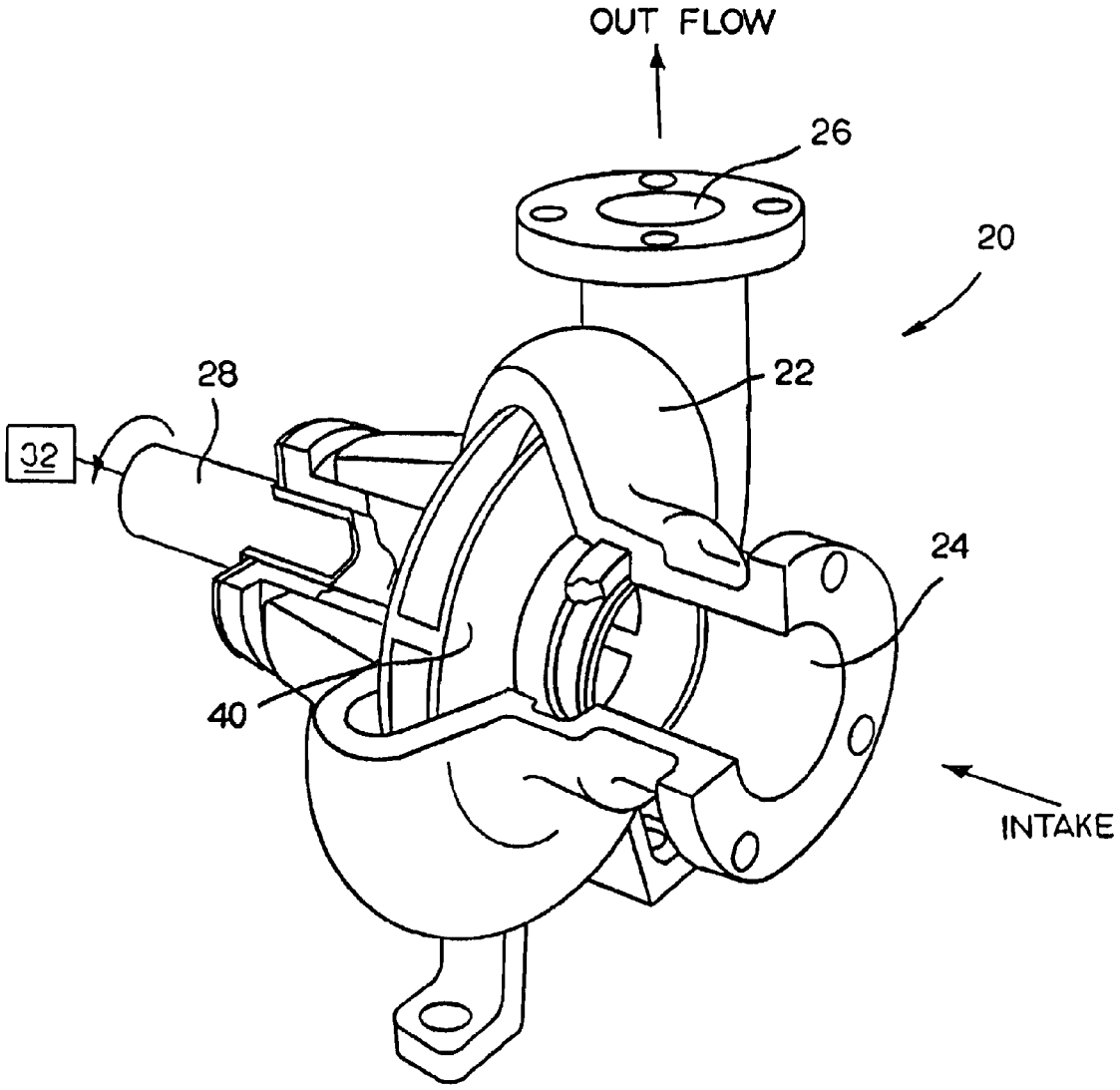
FIG. 1 is an isometric view of a pump that uses a specific embodiment of a closed impeller of the invention.

Referring to the drawings, and in particular to FIG. 1, there is shown a pump 20 that includes a pump housing 22 having an inlet 24 and an outlet 26. The pump 20 further includes a closed impeller 40 within the pump housing 22 wherein a shaft 28 operatively connects to the closed impeller 40 to facilitate the driving of the closed impeller 40. A power source 32 is shown in operative connection to the shaft 28 to thereby rotate the shaft 28.

Figure 2:
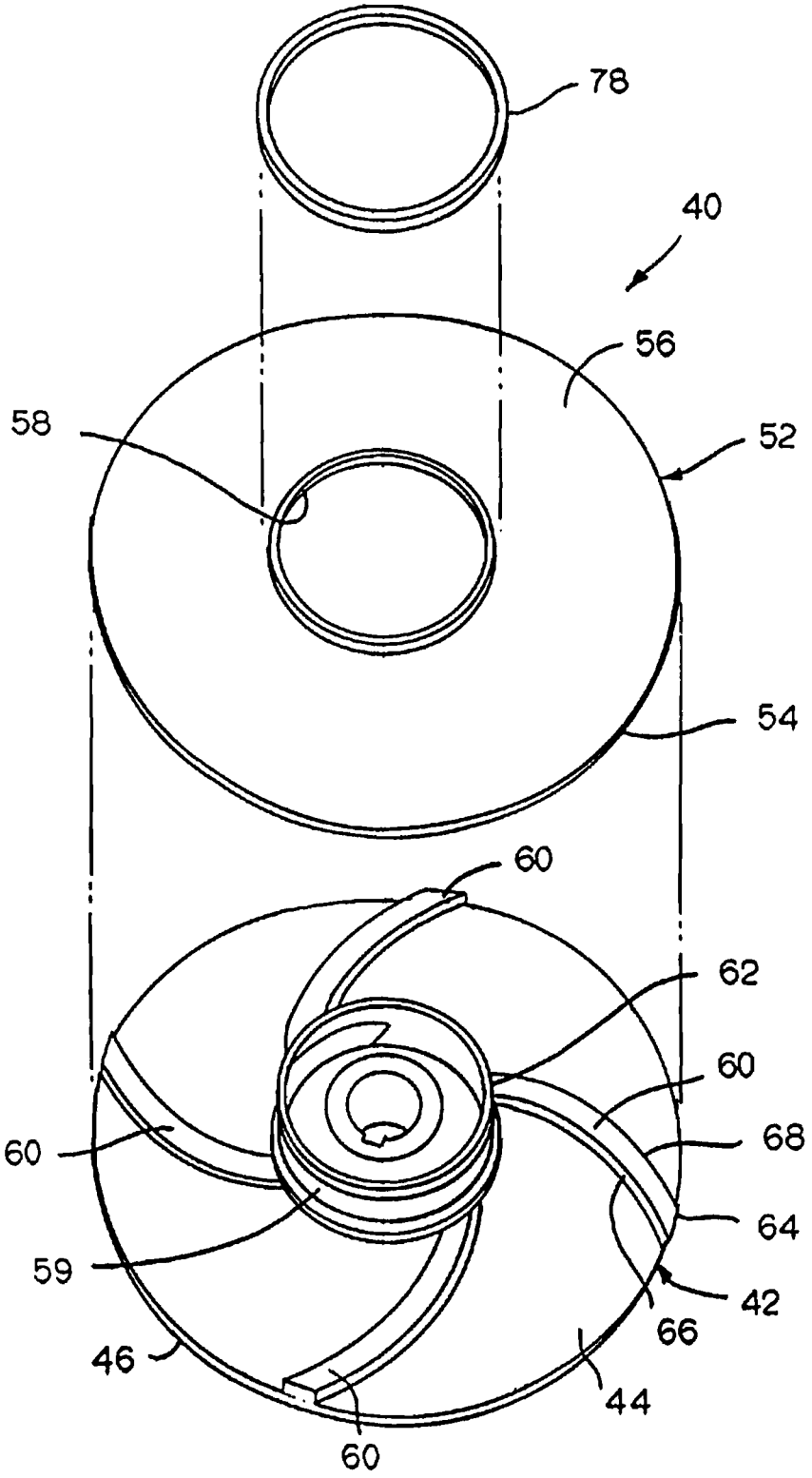
FIG. 2 is an exploded view of the components of the closed impeller in FIG. 1.

Referring to FIG. 2, the closed impeller 40 comprises a base cover 42 which has a base interior surface 44 and a base exterior surface 46. The closed impeller 40 further has a second cover 52 having a second interior surface 54 and a second exterior surface 56. The second cover 52 contains a central aperture 58. The closed impeller 40 further contains a plurality of coated impeller vanes 60 on the base interior surface 44. As illustrated in FIG. 2, the second cover 52 is positioned over the base cover 42 whereby a hub 59 projecting from the base interior surface 44 passes through the central aperture 58. In this figure, a snap ring 78 secures the second cover 52 to the base cover 42.

Figures 3, 3A:
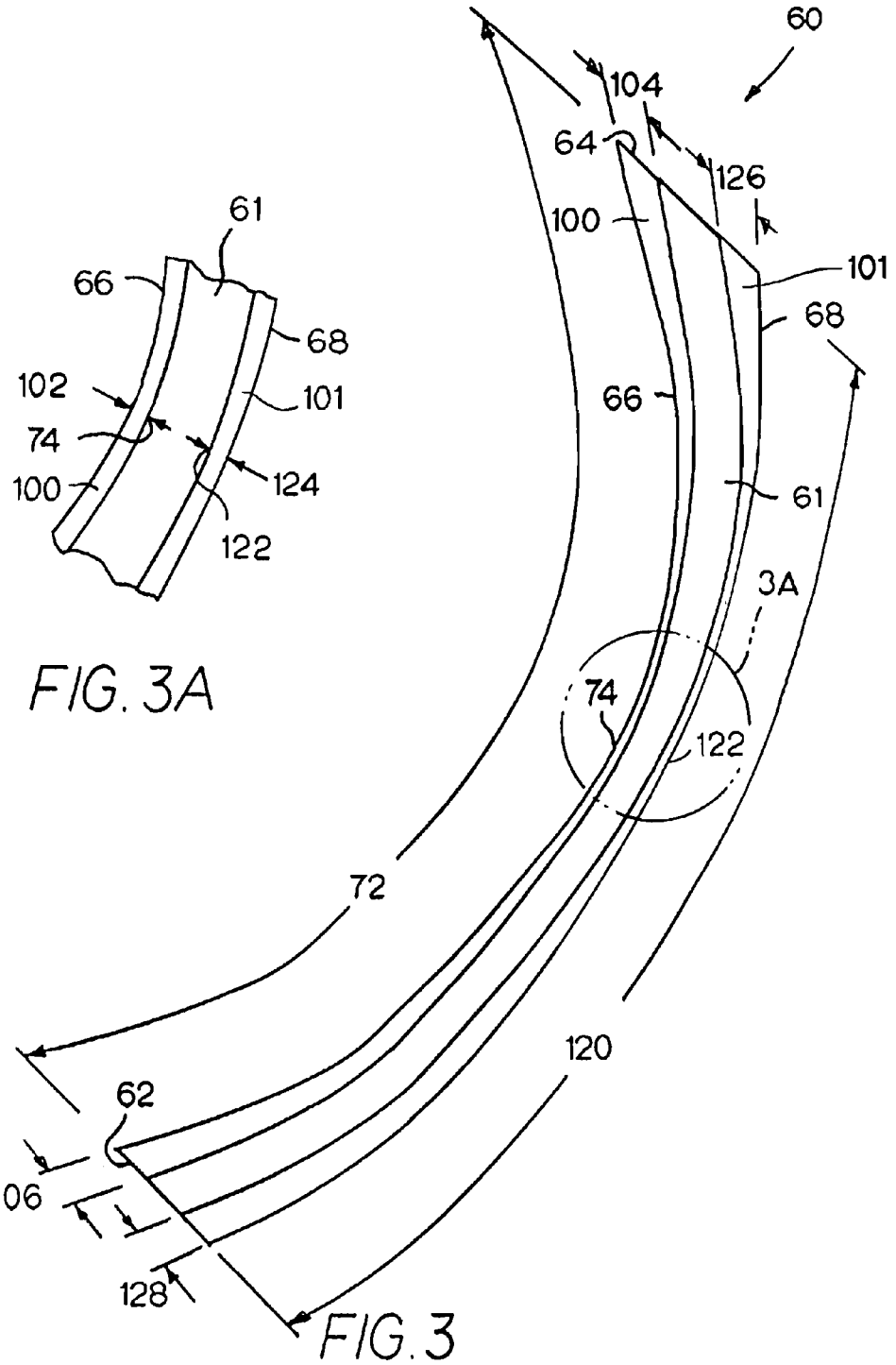
FIG. 3 is a top view of the specific embodiment of one of the vanes of the closed impeller of FIG. 1 showing the coating scheme and the substrate of the vane wherein there is a coating layer on the low pressure side surface and a coating layer on the high pressure side surface.
FIG. 3A is an enlarged view of the portion of the vane of the closed impeller shown in the circle 3A of FIG. 3.

Referring to FIGS. 3 and 3A, there is illustrated the coating scheme of the coated impeller vane 60. The coated impeller vane 60 comprises a vane substrate 61 and a hard coating 100, 101 on the vane substrate 61. The vane substrate 61 can be any one or the following materials: steel, stainless steel or superalloys made by casting, machining from rod or sheet, or powder metallurgical techniques. The specific kinds of materials can be a stainless steel such as, for example, CA6NM or a 300 series or a 400 series stainless steel. The substrate may be a steel material such as 4140 or 4340 or the like. Still further, the vane substrate 61 may be an Inconel® [registered trademark of Huntington Alloys Corporation, Huntington, West Va. 25705 as shown by Federal Trademark Registration No. 308,200] or a Hastelloy® [registered trademark of Haynes International Inc., Kokomo, Ind. 46904 as shown by Federal Trademark Registration No. 269,898] material or a similar nickel-based alloy.

The composition and coating architecture of the hard coating 100, 101 can vary depending upon the specific application to which the closed impeller will be a part. For example, the coating scheme can comprise multilayers wherein the layers can be one of a metal, a ceramic, or a composite. Exemplary metals are titanium, chromium, nickel, zirconium, tungsten, or hafnium. Exemplary ceramic layers are titanium nitride, titanium carbonitride, titanium aluminum nitride, titanium aluminum silicon carbonitride, and tungsten carbide. Exemplary composite layers include tungsten-tungsten carbide, titanium silicon carbonitride (nanocomposite structures), silicon carbonitride, tungsten carbide-cobalt, tungsten carbide-nickel, and nickel-diamond.

As one option, the hard coating 100, 101 can be a monolayer of a nanocomposite of tungsten-tungsten carbide, or titanium silicon carbonitride.

As another option, the hard coating 100, 101 may include a bonding layer of titanium, nickel, chromium, or silicon.

The vane 60 is of a generally arcuate shape and has an inlet distal end 62 and an outlet distal end 64. The vane 60 has a low pressure side surface 66 and a high pressure side surface 68, which is opposite the low pressure side surface 66. The low pressure side surface 66 has a low pressure length (see arcuate line 72) defined between the inlet distal end 62 and the outlet distal end 64. Midway (i.e., approximately half-way along the low pressure length 72) between the inlet distal end 62 and the outlet distal end 64 there is a low pressure midpoint 74 on the low pressure side surface 66. The high pressure side surface 68 has a high pressure length (see arcuate line 120) defined between the inlet distal end 62 and the outlet distal end 64. Midway (i.e., approximately half-way along the high pressure length 120) between the inlet distal end 62 and the outlet distal end 64 there is a high pressure midpoint 122 on the high pressure side surface 68.

The hard coating 100 is on the low pressure side surface 66 and hard coating 101 is on the high pressure side surface 68. The hard coating 100, 101 has a thickness that varies depending upon the location of the hard coating 100, 101. More specifically, the hard coating 100 on the low pressure side surface 66 has a low pressure coating profile, and the hard coating 101 on the high pressure side surface 68 has a high pressure coating profile. As will become apparent from the description below, in the specific embodiment of FIGS. 3 and 3A, the low pressure coating profile may generally corresponds to the high pressure coating profile. More specifically, the coating 100 on the low pressure side surface 66 and the coating 101 on the high pressure side surface 68 may have essentially the same coating thickness and essentially the same coating profile. In many environments, the distal ends (i.e., inlet distal end and the outlet distal end) of the vanes experience greater erosive wear than adjacent to the low or high pressure midpoint. Therefore, the coating profile of either one or both of the low pressure coating profile and the high pressure coating profile displays an increase in the thickness of the coating adjacent the distal ends which provides a performance benefit that increases the effective life of the closed impeller. Such is the case for the low and high pressure coating profiles of the embodiment of FIGS. 3 and 3A.

Referring to the low pressure coating profile, the hard coating 100 on the low pressure side surface 66 has a minimum thickness 102 (see FIG. 3A) at the low pressure midpoint 74. The hard coating 100 has a maximum outlet thickness 104 at the outlet distal end 64. The hard coating 100 has a maximum inlet thickness 106 at the inlet distal end 62. Typically, the thickness of the hard coating on the low pressure side surface 66 varies smoothly between the inlet distal end 62 and the low pressure midpoint 74 and between the outlet distal end 64 and the low pressure midpoint 74. The minimum thickness 102 ranges between about 0.085 and about 0.8 of the maximum outlet thickness 104 at the outlet distal end 64 and of the maximum inlet thickness 106 at the inlet distal end 62 wherein the maximum inlet thickness 106 and the maximum outlet thickness 104 are equal or approximately equal.

As one option to the above range of 0.085-0.8, the minimum thickness 102 ranges between about 0.15 and about 0.60 of the maximum outlet thickness 104 at the outlet distal end 64 and of the maximum inlet thickness 106 at the inlet distal end 62 wherein the maximum inlet thickness 106 and the maximum outlet thickness 104 are equal or approximately equal. As another option, the minimum thickness 102 ranges between about 0.40 and about 0.55 of the maximum outlet thickness 104 at the outlet distal end 64 and of the maximum inlet thickness 106 at the inlet distal end 62 wherein the maximum inlet thickness 106 and the maximum outlet thickness 104 are equal or approximately equal. As still another option, the minimum thickness 102 ranges between about 0.30 and about 0.40 of the maximum outlet thickness 104 at the outlet distal end 64 and of the maximum inlet thickness 106 at the inlet distal end 62 wherein the maximum inlet thickness 106 and the maximum outlet thickness 104 are equal or approximately equal.

Still referring to the low pressure coating profile, in some applications, the nature of the variation of the coating thickness, i.e., low pressure coating profile, can impact the effective life of the closed impeller. As one option, the thickness of the hard coating on the low pressure side surface 66 varies smoothly between the inlet distal end 62 and the low pressure midpoint 74 with the coating thickness at the inlet distal end being equal to about sixty microns and at the coating thickness at the midpoint exhibiting a thickness of about twenty microns. Therefore, the coating thickness at the midpoint equates to about 0.33 of the coating thickness at the inlet distal end and the outlet distal end.

Referring to the high pressure coating profile, the hard coating 101 on the high pressure side surface 68 has a minimum thickness 124 at the high pressure midpoint 122. The hard coating 101 has a maximum outlet thickness 126 at the outlet distal end 64. The hard coating 101 has a maximum inlet thickness 128 at the inlet distal end 62. Typically, the thickness of the hard coating 101 on the low pressure side surface 68 varies smoothly between the inlet distal end 62 and the high pressure midpoint 122 and between the outlet distal end 64 and the high pressure midpoint 122. The minimum thickness 124 ranges between about 0.085 and about 0.8 of the maximum outlet thickness 126 at the outlet distal end 64 and of the maximum inlet thickness 128 at the inlet distal end 62 wherein the maximum inlet thickness 128 and the maximum outlet thickness 126 are equal or approximately equal.

As one option to the above range of 0.085-0.8, the minimum thickness 124 ranges between about 0.15 and about 0.60 of the maximum outlet thickness 126 at the outlet distal end 64 and of the maximum inlet thickness 128 at the inlet distal end 62 wherein the maximum inlet thickness 128 and the maximum outlet thickness 126 are equal or approximately equal. As another option, the minimum thickness 124 ranges between about 0.40 and about 0.55 of the maximum outlet thickness 126 at the outlet distal end 64 and of the maximum inlet thickness 128 at the inlet distal end 62 wherein the maximum inlet thickness 128 and the maximum outlet thickness 126 are equal or approximately equal. As still another option, the minimum thickness 122 ranges between about 0.30 and about 0.40 of the maximum outlet thickness 104 at the outlet distal end 64 and of the maximum inlet thickness 128 at the inlet distal end 62 wherein the maximum inlet thickness 128 and the maximum outlet thickness 126 are equal or approximately equal.

Still referring to the high pressure coating profile, in some applications, the nature of the variation of the coating thickness, i.e., high pressure coating profile, can impact the effective life of the closed impeller. As one option, either alone or with the following option, the thickness of the hard coating 101 on the high pressure side surface 68 varies smoothly between the inlet distal end 62 and the low pressure midpoint 122 with the coating thickness at the inlet distal end being equal to about sixty microns and at the coating thickness at the midpoint exhibiting a thickness of about twenty microns. Therefore, the coating thickness at the midpoint equates to about 0.33 of the coating thickness at the inlet distal end and the outlet distal end.

Generally speaking with reference to each one of the low pressure coating profile and the high pressure coating profile, the thickness of coating scheme on each one of the low and high pressure side surfaces ranges between about 35 micrometers to about 135 micrometers. The thickness of the coating scheme adjacent the inlet distal end and the outlet distal end ranges between about 35 micrometers to about 135 micrometers. The thickness of the coating scheme adjacent the midpoint on the vane ranges between about 35 micrometers to about 100 micrometers. In regard to the low pressure coating profile and the high pressure coating profile, in many environments, the distal ends (i.e., inlet distal end and the outlet distal end) of the vanes experience greater erosive wear than adjacent to the low or high pressure midpoint. Therefore, an increase in the thickness of the coating adjacent the distal ends provide a performance benefit that increases the effective life of the closed impeller. Thus, there is the contemplation that the maximum inlet thickness of the coating at the inlet distal end and the maximum outlet thickness of the coating at the outlet distal end will be greater than the thickness of the coating at the low or high pressure midpoint.

Further, it is a benefit when the coating scheme has a surface with no visible flaws or flaking or exposed substrate surface. It is also beneficial when the visual appearance of the coating scheme has a consistent color.

Figures 4, 4A:
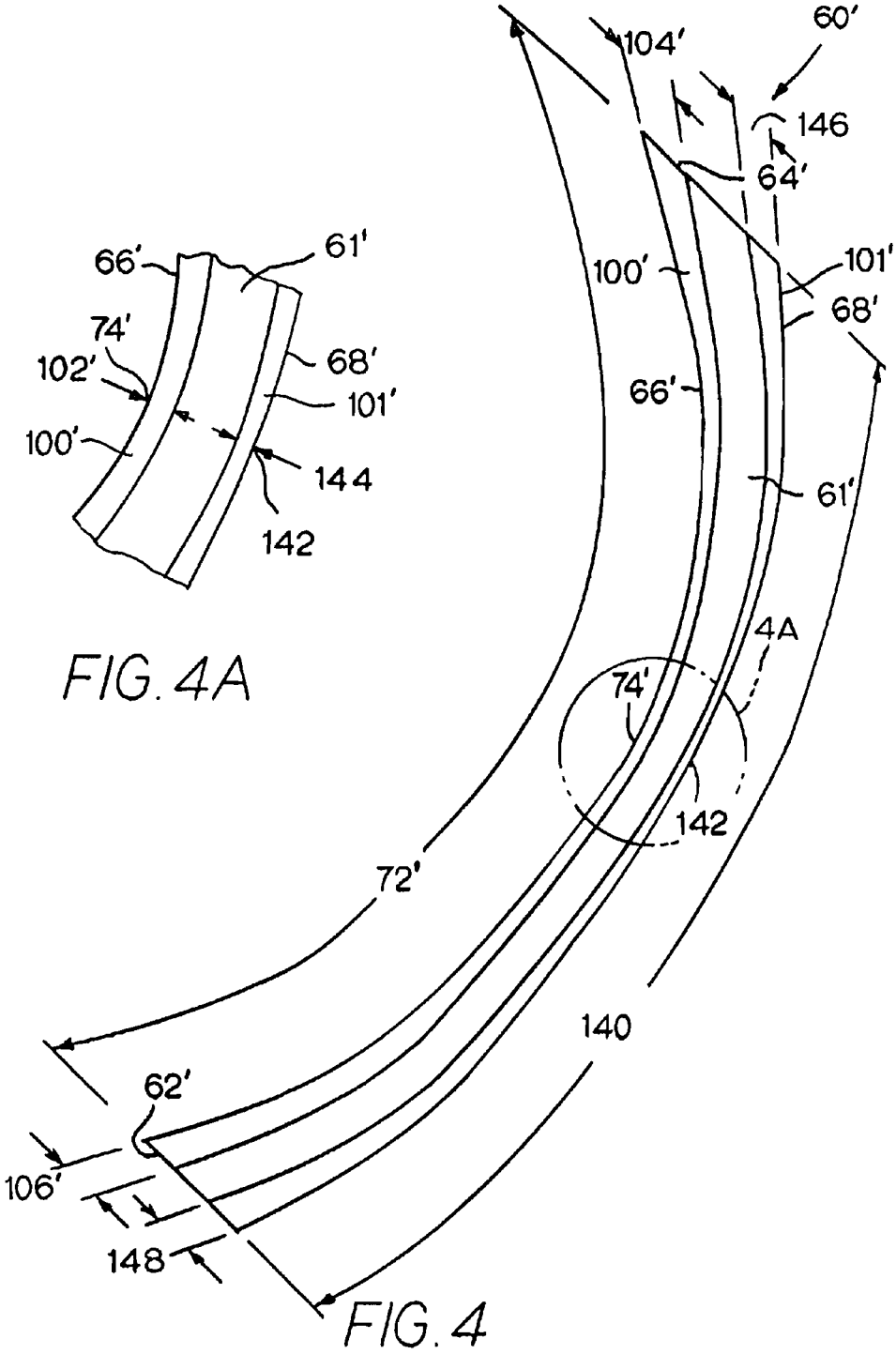
FIG. 4 is a top view of another specific embodiment of one of the vanes suitable for use in the closed impeller of FIG. 1 showing the coating scheme and the substrate of the vane wherein there is a coating layer on the low pressure side surface and a coating layer on the high pressure side surface.
FIG. 4A is an enlarged view of the portion of the vane of the closed impeller shown in circle 4A of FIG. 4.

Referring to FIGS. 4 and 4A, there is illustrated another specific embodiment of the coated vane of a closed impeller designated as 60'. The vane 60' comprises a vane substrate 61'. The vane 60' is of a generally arcuate shape and has an inlet distal end 62' and an outlet distal end 64'. The vane 60' has a low pressure side surface 66' and a high pressure side surface 68', which is opposite the low pressure side surface 66'. The low pressure side surface 66' has a low pressure length (see arcuate line 72') defined between the inlet distal end 62' and the outlet distal end 64'. Midway (i.e., approximately halfway along the low pressure length 72' between the inlet distal end 62' and the outlet distal end 64' there is a low pressure midpoint 74' on the low pressure side surface 66'. The high pressure side surface 68' has a high pressure length (see arcuate line 140) defined between the inlet distal end 62' and the outlet distal end (64'). Midway (i.e., half-way along the high pressure length 140) between the inlet distal end 62' and the outlet distal end 64' there is a high pressure midpoint 142 on the high pressure side surface 68'.

The hard coating 100' is on the low pressure side surface 66' and the hard coating 101' on the high pressure side surface 68'. The hard coating 100', 101' has a thickness that varies depending upon the location of the hard coating 100'. More specifically, the hard coating 100' on the low pressure side surface 66' has a low pressure coating profile, and the hard coating 101' on the high pressure side surface 68' has a high pressure coating profile. As will become apparent from the description below, the low pressure coating profile displays a general correspondence to the high pressure coating profile, except that the extent of the decrease of the coating thickness for the low pressure coating profile is less than the extent of the decrease for the high pressure coating profile.

Referring to the low pressure coating profile, the hard coating 100' on the low pressure side surface 66' has a minimum thickness 102' (see FIG. 4A) at the low pressure midpoint 74'. The hard coating 100' has a maximum outlet thickness 104' at the outlet distal end 64'. The hard coating 100' has a maximum inlet thickness 106' at the inlet distal end 62'. Typically, the thickness of the hard coating on the low pressure side surface 66' varies smoothly between the inlet distal end 62' and the low pressure midpoint 74' and between the outlet distal end 64' and the low pressure midpoint 74'. The minimum thickness 102' ranges between about 0.085 and about 0.8 of the maximum outlet thickness 104' at the outlet distal end 64 and of the maximum inlet thickness 106 at the inlet distal end 62 wherein the maximum inlet thickness 106' and the maximum outlet thickness 104' are equal or approximately equal.

As one option to the above range of 0.085-0.8, the minimum thickness 102' ranges between about 0.15 and about 0.60 of the maximum outlet thickness 104' at the outlet distal end 64' and of the maximum inlet thickness 106' at the inlet distal end 62' wherein the maximum inlet thickness 106' and the maximum outlet thickness 104' are equal or approximately equal. As another option, the minimum thickness 102' ranges between about 0.40 and about 0.55 of the maximum outlet thickness 104' at the outlet distal end 64' and of the maximum inlet thickness 106' at the inlet distal end 62' wherein the maximum inlet thickness 106' and the maximum outlet thickness 104' are equal or approximately equal. As still another option, the minimum thickness 102' ranges between about 0.30 and about 0.40 of the maximum outlet thickness 104' at the outlet distal end 64' and of the maximum inlet thickness 106' at the inlet distal end 62' wherein the maximum inlet thickness 106' and the maximum outlet thickness 104' are equal or approximately equal.

Still referring to the low pressure coating profile, in some applications, the nature of the variation of the coating thickness, i.e., low pressure coating profile, can impact the effective life of the closed impeller. As one option, the thickness of the hard coating on the low pressure side surface 66' varies smoothly between the inlet distal end 62' and the low pressure midpoint 74' with the coating thickness at the inlet distal end being equal to about sixty microns and at the coating thickness at the midpoint exhibiting a thickness of about twenty microns. Therefore, the coating thickness at the midpoint equates to about 0.33 of the coating thickness at the inlet distal end and the outlet distal end.

Referring to the high pressure coating profile, the hard coating 101' on the high pressure side surface 68' has a minimum thickness 144 (see FIG. 4A) at the high pressure midpoint 142. The hard coating 101' has a maximum outlet thickness 146 at the outlet distal end 64'. The hard coating 101' has a maximum inlet thickness 148 at the inlet distal end 62'. Typically, the thickness of the hard coating 101' on the low pressure side surface 68' varies smoothly between the inlet distal end 62' and the high pressure midpoint 142 and between the outlet distal end 64' and the high pressure midpoint 142. The minimum thickness 144 ranges between about 0.085 and about 0.8 of the maximum outlet thickness 146 at the outlet distal end 64' and of the maximum inlet thickness 148 at the inlet distal end 62' wherein the maximum inlet thickness 148 and the maximum outlet thickness 146 are equal or approximately equal.

As one option to the above range of 0.085-0.8, the minimum thickness 144 ranges between about 0.15 and about 0.60 of the maximum outlet thickness 146 at the outlet distal end 64' and of the maximum inlet thickness 148 at the inlet distal end 62' wherein the maximum inlet thickness 148 and the maximum outlet thickness 146 are equal or approximately equal. As another option, the minimum thickness 144 ranges between about 0.40 and about 0.55 of the maximum outlet thickness 146 at the outlet distal end 64' and of the maximum inlet thickness 148 at the inlet distal end 62' wherein the maximum inlet thickness 148 and the maximum outlet thickness 146 are equal or approximately equal. As still another option, the minimum thickness 144 ranges between about 0.30 and about 0.40 of the maximum outlet thickness 146 at the outlet distal end 64' and of the maximum inlet thickness 148 at the inlet distal end 62' wherein the maximum inlet thickness 148 and the maximum outlet thickness 146 are equal or approximately equal.

Still referring to the high pressure coating profile, in some applications, the nature of the variation of the coating thickness, i.e., high pressure coating profile, can impact the effective life of the closed impeller. As one option, either alone or with the following option, the thickness of the hard coating 101' on the high pressure side surface 68' varies smoothly between the inlet distal end 62' and the high pressure midpoint 142 with the coating thickness at the inlet distal end being equal to about sixty microns and at the coating thickness at the midpoint exhibiting a thickness of about twenty microns. The coating thickness at the midpoint equates to about 0.33 of the coating thickness at the inlet distal end and the outlet distal end.

The description of the specific embodiment of FIGS. 4 and 4A shows that the low pressure coating profile displays a general correspondence to the high pressure coating profile, except that the extent of the decrease of the coating thickness for the low pressure coating profile is less than the extent of the decrease for the high pressure coating profile. In regard to the quantitative ranges for the coating thicknesses, there is the contemplation of the following relationships. The minimum low pressure thickness can range between about 0.30 and about 0.60 of either one of the maximum low pressure outlet thickness at the outlet distal end or the maximum low pressure inlet thickness at the inlet distal end; and the minimum high pressure thickness can range between about 0.085 and about 0.20 of either one of the maximum high pressure outlet thickness at the outlet distal end or the maximum high pressure inlet thickness at the inlet distal end. As another option, the minimum low pressure thickness can be equal to about 0.50 of either one of the maximum low pressure outlet thickness at the outlet distal end or the maximum low pressure inlet thickness at the inlet distal end; and the minimum high pressure thickness can be equal to about 0.14 of either one of the maximum high pressure outlet thickness at the outlet distal end or the maximum high pressure inlet thickness at the inlet distal end.

Generally speaking with reference to each one of the low pressure coating profile and the high pressure coating profile, the thickness of coating scheme on each one of the low and high pressure side surfaces ranges between about 35 micrometers to about 135 micrometers. The thickness of the coating scheme adjacent the inlet distal end and the outlet distal end ranges between about 35 micrometers to about 135 micrometers. The thickness of the coating scheme adjacent the midpoint on the vane ranges between about 35 micrometers to about 100 micrometers. In regard to the low pressure coating profile and the high pressure coating profile, in many environments, the distal ends (i.e., inlet distal end and the outlet distal end) of the vanes experience greater erosive wear than adjacent to the low or high pressure midpoint. Therefore, an increase in the thickness of the coating adjacent the distal ends provide a performance benefit that increases the effective life of the closed impeller. Thus, there is the contemplation that the maximum inlet thickness of the coating at the inlet distal end and the maximum outlet thickness of the coating at the outlet distal end will be greater than the thickness of the coating at the low or high pressure midpoint.

Further, it is a benefit when the coating scheme has a surface with no visible flaws or flaking or exposed substrate surface. It is also beneficial when the visual appearance of the coating scheme has a consistent color.

As can be appreciated from the above embodiments, the low pressure coating profile and the high pressure coating profile can be essentially the same with the same thicknesses. Further, there is the appreciation that the low pressure coating profile and the high pressure coating profile can be essentially the same, but that the extent of variation between the maximum and minimum coating thicknesses can be different. In the case of the embodiment of FIGS. 4 and 4A, the coating thicknesses of the coating 100' on the low pressure side surface 66' vary less than the thicknesses of the coating 101' on the high pressure side surface 68'. There should be an appreciation that in other instances, the coating thicknesses of the coating 100' on the low pressure side surface 66' can vary more than the thicknesses of the coating 101' on the high pressure side surface 68'.

Other beneficial physical properties of the coating scheme are: an adhesion using Rockwell indentation adhesion strength of greater than 70 Kg; a toughness as measured by the ratio of hardness (GPa)/modulus of elasticity (GPa) of greater than about 0.05; a resilience such that there is no visible spalling on elastically deformed areas of the substrate; wear resistance using the ASTM G65-04 (2010) ["Standard Test Method for Measuring Abrasion Using the Dry Sand/Rubber Wheel Apparatus"] test wherein the wear resistance is greater than 5 times that of an uncoated substrate; a corrosion resistance such as that it is resistant to acids, sulfides and brine solutions; an erosion resistance using the ASTM G76-07 ["Standard Test Method for Conducting Erosion Tests by Solid Particle Impingement Using Gas Jets"] test such that resistance is at least 1.5-2 times the erosion resistance of an uncoated substrate at low impingement angles such as 20° incident angle; a hardness such that the coating must have a hardness greater than about 1100 HV; and the hardness of the vane substrate must not have been reduced by more than 4 HRC through the application of the coating.

One suitable technique is the plasma enhanced magnetron sputtering (PEMS) process. The PEMS process is shown and described in United States Patent Application Publication No. US2009/0214787A1 to Wei et al. and entitled EROSION RESISTANT COATINGS. Further, the PEMS process is shown and described in the article Wei et al., "Deposition of thick nitrides and carbonitrides for sand erosion protection", *Surface & Coatings Technology,* 201 (2006), pp. 4453-4459.

Another suitable process is shown in U.S. Pat. No. 4,427,445 to HolzI et al. entitled TUNGSTEN ALLOYS CONTAINING A15 STRUCTURE AND METHOD FOR MAKING SAME.

The process used to apply the coating scheme operates at a temperature no greater than about 600° C. As an alternative, the process used to apply the coating scheme operates at a temperature no greater than about 550° C.

Set forth below are specific embodiments of the invention.

For Example 1, the coated article comprised a cast stainless steel closed impeller with an effective diameter of about 8 inches (20 centimeters) and which had a series of five vanes with each vane having an effective arc length of about 6.2 inches (16 centimeters). This closed impeller was coated with a hard, but tough, coating comprising tungsten carbide and tungsten using a low temperature CVD technique. The low temperature CVD technique comprised the basic steps of: applying a few microns of nickel metal to the iron-based substrate, heating the part to about 500-520° C. in a vacuum, flowing heated gaseous reaction products over the part, then cooling to room temperature in an inert atmosphere.

For Example 1, the resulting coating had a consistent coating thickness at similar distances along each vane as measured from the inlet distal end of the vane. The coating thickness variation along the high pressure side of a vane showed a maximum coating thickness of about 60 microns near the ends with a minimal coating thickness of about 20 microns near the midpoint.

For Example 2, the coated article comprised a cast stainless steel closed impeller with an effective diameter of about 8 inches (20 centimeters) and which had a series of five vanes with each vane having an effective arc length of about 6.2 inches (16 centimeters). This closed impeller was coated with a hard, but tough, coating using the same low temperature CVD technique as described above but in a separate batch.

For Example 2, the resulting coating had consistent coating thickness at similar distances along each vane as measured from the inlet distal end of the vane. The thickness variation along the high pressure side of the vane showed a minimal coating thickness of about fourteen percent (14%) near the midpoint as compared to the inlet and outlet ends. On the low pressure side of this vane, the coating thickness varied by fifty percent (50%) at the midpoint as compared to the inlet and outlet ends.

In the above description, the minimal coating thicknesses, whether for the low pressure side or the high pressure side of the vane, have been expressed relative to the coating thicknesses of the maximum inlet thickness and the maximum outlet thickness wherein the maximum thicknesses are equal or approximately equal. There should be an understanding that in some instances the minimum coating thicknesses can be defined relative to either one of these maximum coating thicknesses. Therefore, in one range there is the contemplation that the minimum low pressure thickness ranges between about 0.085 and about 0.8 of either one of the maximum low pressure outlet thickness at the outlet distal end or the maximum low pressure inlet thickness at the inlet distal end, and that the minimum high pressure thickness ranges between about 0.085 and about 0.8 of either one of the maximum high pressure outlet thickness at the outlet distal end or the maximum high pressure inlet thickness at the inlet distal end.

It is apparent that the present invention provides a coating scheme that improves the erosion resistance and the corrosion resistance of the coated vane of the closed impeller without negatively impacting the mechanical performance of the closed impeller.

It is further apparent that the present invention provides a way to treat a component such as a closed impeller so as to improve of the effective life thereof. It is apparent that the present invention provides a way to treat a component such as a closed impeller so as to improve of the effective life thereof, especially when the areas needing protection are hard-to-reach and/or require tight dimensional tolerances.

It is apparent that the present invention provides a coating on a closed impeller (and especially the vane of a closed impeller) that has excellent adhesion. It is apparent that the present invention provides a coating on a closed impeller (and especially the vane of a closed impeller) wherein the coating scheme is metallurgically bonded to the surface of the substrate of the vane. It is apparent that the present invention provides a coating on a closed impeller (and especially the vane of the closed impeller) that does not possess unintended variations in the thickness of the coating.

It is still apparent that the present invention provides a coating on a closed impeller (and especially the vane of the closed impeller) that does not require the high heat to apply the coating and thereby distort the geometry of the components including the vanes of the closed impeller. It is apparent that the present invention provides a way to treat a component such as a closed impeller without the need to use higher deposition temperatures such as are extant with typical CVD and PVD techniques.

It is apparent that the present invention provides a way to treat a component such as a closed impeller (and especially the vanes thereof) so that the coating can be applied to hard-to-reach areas unavailable to be coated by line-of-sight techniques.

It is apparent that the present invention provides a coating on a closed impeller (and especially the vane of the closed impeller) that exhibits sufficient thickness such as, at least about 35 micrometers.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed:

1. A closed impeller comprising:

a base cover having a base interior surface;

a second cover;

a vane on the base interior surface, the vane being of a generally arcuate shape and having an inlet distal end and an outlet distal end;

the vane having a low pressure side surface, the low pressure side surface having a low pressure length between the inlet distal end and the outlet distal end, and a low pressure midpoint on the low pressure length approximately midway between the inlet distal end and the outlet distal end;

a hard low pressure coating on the low pressure side surface, the hard low pressure coating having a minimum low pressure coating thickness at the low pressure midpoint, the hard low pressure coating having a maximum low pressure outlet coating thickness at the outlet distal end, and the hard low pressure coating having a maximum low pressure inlet coating thickness at the inlet distal end;

the minimum low pressure coating thickness ranging between about 0.085 and about 0.8 of either one of the maximum low pressure outlet coating thickness at the outlet distal end or the maximum low pressure inlet coating thickness at the inlet distal end;

the vane having a high pressure side surface, the high pressure side surface having a high pressure length between the inlet distal end and the outlet distal end, and a high pressure midpoint on the high pressure length approximately midway between the inlet distal end and the outlet distal end;

a hard high pressure coating on the high pressure side surface, the hard high pressure coating having a minimum high pressure coating thickness at the high pressure midpoint, the hard high pressure coating having a maximum high pressure outlet coating thickness at the outlet distal end, and the hard high pressure coating having a maximum high pressure inlet coating thickness at the inlet distal end; and the minimum high pressure coating thickness ranging between about 0.085 and about 0.8 of either one of the maximum high pressure outlet coating thickness at the outlet distal end or the maximum high pressure inlet coating thickness at the inlet distal end.

2. The closed impeller according to claim 1 wherein the maximum low pressure outlet coating thickness being about equal to the maximum low pressure inlet coating thickness, and the maximum high pressure outlet coating thickness being about equal to the maximum high pressure inlet coating thickness.

3. The closed impeller according to claim 1 wherein the maximum low pressure outlet coating thickness is equal to the maximum high pressure outlet coating thickness; and the maximum low pressure inlet coating thickness is equal to the maximum high pressure inlet coating thickness.

4. The closed impeller according to claim 1 wherein the maximum low pressure inlet coating thickness is greater than the maximum high pressure inlet coating thickness, and the maximum low pressure outlet coating thickness is greater than the maximum high pressure outlet coating thickness.

5. The closed impeller according to claim 1 wherein the maximum low pressure inlet coating thickness is less thick than the maximum high pressure inlet coating thickness, and the maximum low pressure outlet coating thickness is less thick than the maximum high pressure outlet coating thickness.

6. The closed impeller according to claim 1 wherein the minimum low pressure coating thickness ranging between about 0.15 and about 0.60 of either one of the maximum low pressure outlet coating thickness at the outlet distal end or the maximum low pressure inlet coating thickness at the inlet distal end; and the minimum high pressure coating thickness ranging between about 0.15 and about 0.60 of either one of the maximum high pressure outlet coating thickness at the outlet distal end or the maximum high pressure inlet coating thickness at the inlet distal end.

7. The closed impeller according to claim 1 wherein the minimum low pressure coating thickness ranging between about 0.40 and about 0.55 of either one of the maximum low pressure outlet thickness at the outlet distal end or the maximum low pressure inlet thickness at the inlet distal end; and the minimum high pressure coating thickness ranging between about 0.40 and about 0.55 of either one of the maximum high pressure outlet thickness at the outlet distal end or the maximum high pressure inlet thickness at the inlet distal end.

8. The closed impeller according to claim 1 wherein the minimum low pressure coating thickness ranging between about 0.30 and about 0.40 of either one of the maximum low pressure outlet thickness at the outlet distal end or the maximum low pressure inlet thickness at the inlet distal end; and the minimum high pressure coating thickness ranging between about 0.30 and about 0.40 of either one of the maximum high pressure outlet thickness at the outlet distal end or the maximum high pressure inlet thickness at the inlet distal end.

9. The closed impeller according to claim 1 wherein the minimum low pressure coating thickness ranging between about 0.30 and about 0.60 of either one of the maximum low pressure outlet thickness at the outlet distal end or the maximum low pressure inlet thickness at the inlet distal end; and the minimum high pressure coating thickness ranging between about 0.085 and about 0.20 of either one of the maximum high pressure outlet thickness at the outlet distal end or the maximum high pressure inlet thickness at the inlet distal end.

10. The closed impeller according to claim 1 wherein the minimum low pressure coating thickness being equal to about 0.50 of either one of the maximum low pressure outlet thickness at the outlet distal end or the maximum low pressure inlet thickness at the inlet distal end; and the minimum high pressure coating thickness being equal to about 0.14 of either one of the maximum high pressure outlet thickness at the outlet distal end or the maximum high pressure inlet thickness at the inlet distal end.

11. The closed impeller according to claim 1 wherein the minimum low pressure coating thickness being equal to about 0.33 of either one of the maximum low pressure outlet thickness at the outlet distal end or the maximum low pressure inlet thickness at the inlet distal end; and the minimum high pressure coating thickness being equal to about 0.33 of either one of the maximum high pressure outlet thickness at the outlet distal end or the maximum high pressure inlet thickness at the inlet distal end.

12. The closed impeller according to claim 1 wherein the base cover further including a base exterior surface, the second cover having a second interior surface and a second exterior surface.

13. The closed impeller according to claim 1 wherein the minimum low pressure coating thickness ranges between about 35 micrometers and about 100 micrometers, and the minimum high pressure coating thickness ranges between about 35 micrometers and about 100 micrometers.

14. The closed impeller according to claim 1 wherein the maximum low pressure outlet coating thickness ranges between about 35 micrometers and about 135 micrometers, the maximum low pressure inlet coating thickness ranges between about 35 micrometers and about 135 micrometers, the maximum high pressure outlet coating thickness ranges between about 35 micrometers and about 135 micrometers, and the maximum high pressure inlet coating thickness ranges between about 35 micrometers and about 135 micrometers.

15. A coated impeller vane comprising:

a vane substrate and a hard coating;

the vane being of a generally arcuate shape and having an inlet distal end and an outlet distal end;

the vane having a low pressure side surface, the low pressure side surface having a low pressure length between the inlet distal end and the outlet distal end, and a low pressure midpoint on the low pressure length approximately midway between the inlet distal end and the outlet distal end;

a hard low pressure coating on the low pressure side surface, the hard low pressure coating having a minimum low pressure coating thickness at the low pressure midpoint, the hard low pressure coating having a maximum low pressure outlet coating thickness at the outlet distal end, and the hard low pressure coating having a maximum low pressure inlet coating thickness at the inlet distal end;

the minimum low pressure coating thickness ranging between about 0.085 and about 0.8 of either one of the maximum low pressure outlet coating thickness at the outlet distal end or the maximum low pressure inlet coating thickness at the inlet distal end;

the vane having a high pressure side surface, the high pressure side surface having a high pressure length between the inlet distal end and the outlet distal end, and a high pressure midpoint on the high pressure length approximately midway between the inlet distal end and the outlet distal end;

a hard high pressure coating on the high pressure side surface, the hard high pressure coating having a minimum high pressure coating thickness at the high pressure midpoint, the hard high pressure coating having a maximum high pressure outlet coating thickness at the outlet distal end, and the hard high pressure coating having a maximum high pressure inlet coating thickness at the inlet distal end; and the minimum high pressure coating thickness ranging between about 0.085 and about 0.8 of either one of the maximum high pressure outlet coating thickness at the outlet distal end or the maximum high pressure inlet coating thickness at the inlet distal end.

16. The coated impeller vane according to claim 15 wherein the maximum low pressure coating outlet thickness being about equal to the maximum low pressure inlet thickness, and the maximum high pressure outlet coating thickness being about equal to the maximum high pressure inlet thickness.

17. The coated impeller vane according to claim 15 wherein the maximum low pressure outlet coating thickness is equal to the maximum high pressure outlet coating thickness; and the maximum low pressure inlet coating thickness is equal to the maximum high pressure inlet coating thickness.

18. The coated impeller vane according to claim 15 wherein the maximum low pressure coating inlet thickness that is greater than the maximum high pressure inlet coating thickness, and the maximum low pressure outlet coating thickness that is greater than the maximum high pressure outlet coating thickness.

19. The coated impeller vane according to claim 15 wherein the maximum low pressure inlet coating thickness is less than the maximum high pressure inlet coating thickness, and the maximum low pressure outlet coating thickness is less than the maximum high pressure outlet coating thickness.

20. The coated impeller vane according to claim 15 wherein the minimum low pressure coating thickness ranging between about 0.40 and about 0.55 of either one of the maximum low pressure outlet coating thickness at the outlet distal end or the maximum low pressure inlet coating thickness at the inlet distal end; and the minimum high pressure thickness ranging between about 0.40 and about 0.55 of either one of the maximum high pressure outlet coating thickness at the outlet distal end or the maximum high pressure inlet coating thickness at the inlet distal end.

21. The coated impeller vane according to claim 15 wherein the minimum low pressure coating thickness ranging between about 0.30 and about 0.60 of either one of the maximum low pressure outlet coating thickness at the outlet distal end or the maximum low pressure inlet coating thickness at the inlet distal end; and the minimum high pressure coating thickness ranging between about 0.085 and about 0.20 of either one of the maximum high pressure outlet coating thickness at the outlet distal end or the maximum high pressure inlet coating thickness at the inlet distal end.

22. The coated impeller vane according to claim 15 wherein the minimum low pressure coating thickness ranges between about 35 micrometers and about 100 micrometers, and the minimum high pressure coating thickness ranges between about 35 micrometers and about 100 micrometers.

23. The coated impeller vane according to claim 15 wherein the maximum low pressure outlet coating thickness ranges between about 35 micrometers and about 135 micrometers, the maximum low pressure inlet coating thickness ranges between about 35 micrometers and about 135 micrometers, the maximum high pressure outlet coating thickness ranges between about 35 micrometers and about 135 micrometers, and the maximum high pressure inlet coating thickness ranges between about 35 micrometers and about 135 micrometers.

24. A pump comprising:

a pump housing having an inlet and an outlet;

a closed impeller within the pump housing wherein the closed impeller comprising:

a base cover having a base interior surface;

a second cover;

a vane on the base interior surface, the vane being of a generally arcuate shape and having an inlet distal end and an outlet distal end;

the vane having a low pressure side surface, the low pressure side surface having a low pressure length between the inlet distal end and the outlet distal end, and a low pressure midpoint on the low pressure length approximately midway between the inlet distal end and the outlet distal end;

a hard low pressure coating on the low pressure side surface, the hard low pressure coating having a minimum low pressure coating thickness at the low pressure midpoint, the hard low pressure coating having a maximum low pressure outlet coating thickness at the outlet distal end, and the hard low pressure coating having a maximum low pressure inlet coating thickness at the inlet distal end;

the minimum low pressure coating thickness ranging between about 0.085 and about 0.8 of either one of the maximum low pressure outlet coating thickness at the outlet distal end or the maximum low pressure inlet coating thickness at the inlet distal end;

the vane having a high pressure side surface, the high pressure side surface having a high pressure length between the inlet distal end and the outlet distal end, and a high pressure midpoint on the high pressure length approximately midway between the inlet distal end and the outlet distal end;

a hard high pressure coating on the high pressure side surface, the hard high pressure coating having a minimum high pressure coating thickness at the high pressure midpoint, the hard high pressure coating having a maximum high pressure outlet coating thickness at the outlet distal end, and the hard high pressure coating having a maximum high pressure inlet coating thickness at the inlet distal end; and the minimum high pressure coating thickness ranging between about 0.085 and about 0.8 of either one of the maximum high pressure outlet coating thickness at the outlet distal end or the maximum high pressure inlet coating thickness at the inlet distal end.

* * * * *